US006019004A

United States Patent [19]

Conley et al.

[11] Patent Number: 6,019,004

[45] Date of Patent: Feb. 1, 2000

[54] DETACHABLE PIPETTE BARREL

[75] Inventors: Paul G. Conley, St. Charles; Eugene R. Appal, Florissant, both of Mo.

[73] Assignee: Sherwood Services, AG, Schaffhausen, Switzerland

[21] Appl. No.: 08/926,095

[22] Filed: Sep. 9, 1997

Related U.S. Application Data

[60] Provisional application No. 60/026,853, Sep. 10, 1996.

[51] Int. Cl.[7] ..... B01L 3/02

[52] U.S. Cl. ..... 73/864.16; 73/863.32; 73/864.17; 422/923

[58] Field of Search ..... 73/864.16, 864.17, 73/864.18, 864.14, 863.32; 422/923

[56] References Cited

U.S. PATENT DOCUMENTS

| | | | |
|---|---|---|---|
| 3,933,048 | 1/1976 | Scordato . | |
| 3,977,574 | 8/1976 | Thomas | 222/391 |
| 4,009,611 | 3/1977 | Koffer et al. . | |
| 4,054,062 | 10/1977 | Branham . | |
| 4,082,121 | 4/1978 | Sturm et al. | 73/864.16 X |
| 4,096,750 | 6/1978 | Sturm . | |
| 4,096,751 | 6/1978 | Withers et al. . | |
| 4,099,548 | 7/1978 | Sturm et al. | 141/27 |
| 4,327,595 | 5/1982 | Schultz | 73/864.12 |
| 4,418,580 | 12/1983 | Satchell et al. | 73/864.13 |
| 4,442,722 | 4/1984 | Meyer | 73/864.18 |
| 4,487,081 | 12/1984 | De Vaughn et al. | 73/864.16 X |
| 4,567,780 | 2/1986 | Oppenlander et al. | 73/864.16 |
| 4,671,123 | 6/1987 | Magnussen, Jr. et al. | 73/864.16 |
| 4,757,437 | 7/1988 | Nishimura | 364/167 |
| 4,779,467 | 10/1988 | Rainin et al. | 73/864.17 |
| 4,821,586 | 4/1989 | Scordato et al. | 73/864.18 |
| 4,905,526 | 3/1990 | Magnussen, Jr. et al. | 73/864.18 |
| 4,909,991 | 3/1990 | Oshikubo | 73/864.18 X |
| 4,933,148 | 6/1990 | Perlman | 73/864.14 X |
| 5,002,737 | 3/1991 | Tervamaki | 422/100 |
| 5,021,217 | 6/1991 | Oshikubo | 422/100 |
| 5,187,990 | 2/1993 | Magnussen, Jr. et al. | 73/864.18 |
| 5,892,161 | 4/1999 | Conley et al. | 73/864.18 |

*Primary Examiner*—Thomas P. Noland
*Attorney, Agent, or Firm*—Mark S. Leonardo, Esq.; Brown, Rudnick, Freed & Gesmer, P.C.

[57] ABSTRACT

The present invention relates to a detachable barrel assembly for use with an electronically monitored mechanical pipette. The detachable barrel is made to retain all internal elements thereof in proper operating position even when the barrel assembly is detached from the pipette. The barrel assembly may be of a single channel or multi channel configuration. The barrel assembly may be removed from the pipette in order to allow it to be cleaned, such as by autoclaving, and reattached to the pipette. In this manner, the electrical components of the pipette itself do not need to be subjected to autoclaving whenever the barrel assembly needs to be cleaned. Further, the self-contained design of the barrel assembly simplifies detachment and reattachment thereof to the pipette.

9 Claims, 14 Drawing Sheets

DETACHABLE PIPETTE BARREL

CROSS-REFERENCE TO RELATED APPLICATIONS

The present application claims the benefit of U.S. Provisional Application Ser. No. 60/026,853 filed Sep. 10, 1996, the contents of which are incorporated herein by reference in its entirety.

BACKGROUND OF THE INVENTION

1. Field of the Invention

The invention relates generally to a pipette. More specifically, the invention relates to a detachable barrel for an electronically monitored mechanical pipette. Even more specifically, the invention relates to a detachable barrel which can be cleaned, such as by autoclaving, and replaced on the pipette such that the pipette can be cleaned without electrical components of the pipette being subjected to autoclaving.

2. Prior Art

Mechanically operated micropipettes are well known in the art as exemplified by U.S. Pat. No. 4,909,991 to Oshikubo. In such prior art devices, the volume of liquid to be dispensed by the pipette is generally indicated to the operator by means of a mechanical display. The display commonly consists of a set of rotary drums driven by a gear mechanism attached to the actuating shaft of the pipette, such that rotation of the actuating shaft causes the drums to rotate to display a new setting. However, due to unavoidable mechanical wear and tear on pipettes, the amount of fluid actually being delivered by a pipette may not actually correspond to the volume being indicated by the mechanical displayed. Further, accuracy may degrade over time as the actuating elements, such as the shaft, gears, and rotary drum, wear out.

Electrically driven pipettes are also well known in the art as exemplified by U.S. Pat. No. 4,905,526 to Magnussen, Jr. et al. This type of instrument commonly includes an electronic display for displaying the volume of fluid to be dispensed by the pipette, and an actuator generally comprised of an electric drive mechanism, such as a stepper motor. The stepper motor generally drives a rotor, which is attached by a threaded screw to an actuator shaft, the threaded screw changes the rotational motion of the motor into linear motion of the actuator shaft. The shaft thereafter drives a piston to displace fluid for pipetting. Although electrically operated pipettes have some advantages over mechanically operated pipettes, they nevertheless suffer from several drawbacks. First, the enlarged size of an electrically operated pipette, due to the need to accommodate the electric driving mechanism, and the added electronic hardware, make the device very difficult to handle for the operator. Further, the electronic motor can be very power demanding and thus necessitate connection of the pipette to a power source, or the use of large batteries which can be rapidly drained of power.

Electrically monitored mechanical pipettes are also known in the art as exemplified by U.S. Pat. No. 4,567,780 to Oppenlander et al. This type of instrument generally includes a plunger having an adjustable stroke length which is generally adjusted by rotating the plunger itself. The electrical monitoring system monitors plunger rotation and electronically displays the volume delivery setting corresponding to the plunger position. The device continuously monitors the plunger position and volume delivery setting of the pipette and allows for removal of the plunger tip and capillary assembly. Although this device overcomes several of the disadvantages of mechanical and electrical pipettes, it nevertheless fails to completely resolve the problem of cleaning the pipette after use, without subjecting the electronics thereof to the cleaning process.

OBJECTS AND SUMMARY OF THE INVENTION

The principal object of the present invention is to provide an electronically monitored mechanical pipette which includes a detachable barrel which can be cleaned such as by autoclaving, and replaced on the pipette.

Another object of the present invention is to provide an electronically monitored mechanical pipette with a removable barrel which is completely self-contained such that removing the barrel from the pipette maintains all internal barrel and pipette components in place.

A further object of the present invention is to provide an electronically monitored mechanical pipette which includes a removable barrel system which allows both single and multiple channel barrels to be removably attached thereto.

Briefly, and in general terms, the present invention provides for a detachable barrel for an electronically monitored mechanical pipette which enables cleaning of the barrel portion of the pipette without subjecting the electronics thereof to cleaning.

In the presently preferred embodiment, shown by way of example and not necessarily by way of limitation, an electrically monitored mechanical pipette made in accordance with the principals of the present invention includes a volume delivery adjustment mechanism which includes a plunger, an advancer, a driver, and a threaded bushing. The volume delivery adjusted mechanism is monitored by an electrical volume monitoring system which preferably includes a transducer assembly having two Hall-effect sensors, and an electronics assembly which includes a microprocessor and a display. During volume delivery adjustment, the sensors send a set of transducer signals to the electronics assembly which computes and displays the new fluid volume delivery setting.

A microswitch assembly is provided for detecting relative rotational motion between the volume delivery adjustment mechanism and the pipette and to signal the electronics assembly that the fluid volume delivery setting is being changed. Upon receipt of a signal, in the form of an interrupt signal, from the microswitch, the electronics assembly powers up the transducer assembly which then tracks the motion of the volume delivery adjustment mechanism. The transducer sensor signals are received by the electronics assembly which computes and displays the new fluid volume delivery setting. Once the volume delivery adjustment mechanism is no longer being rotated, the electronics assembly shuts down the power to the transducer assembly to minimize power consumption of the pipette.

In one preferred embodiment of the detachable barrel assembly, a single channel unit is disclosed in which the piston adaptor thereof passes through an enclosed housing area to attach to a single piston which draws fluid through a single fluid channel.

In another preferred embodiment of the barrel assembly, the piston adaptor thereof passes through the enclosed barrel housing and attaches to a piston bar, which in turn drives several pistons through several individual fluid channels for receiving and delivering multiple channels simultaneously. The barrel housing of each of the single and multiple channel barrel assemblies are totally self-contained such that removal of the barrel assembly from the pipette does not result in the loss or displacement of any elements of either the pipette or the barrel assembly.

Each barrel assembly of the present invention is capable of being cleaned such as by autoclaving while separated from the pipette and can thereafter be easily reattached to the pipette for further use.

These and other objects and advantages of the present invention will become apparent from the following more detailed description, when taken in conjunction with the accompanying drawings in which like elements are identified with like numerals throughout.

DETAILED DESCRIPTION OF THE PREFERRED EMBODIMENT

Figure 1:
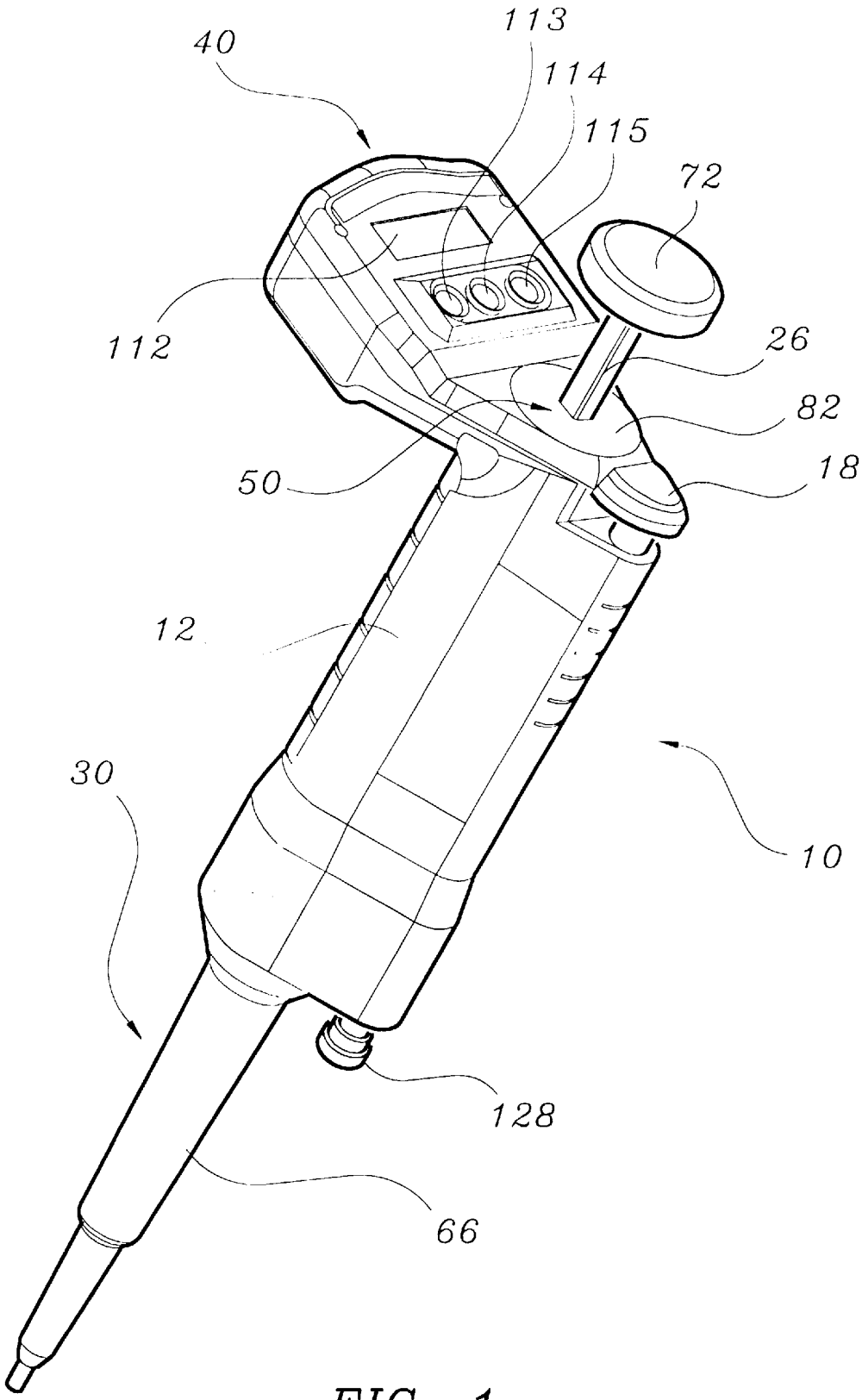
FIG. 1 is a perspective view of a pipette made in accordance with the principals of the present invention.

As shown in the exemplary drawings for the purposes of illustration, an embodiment of an electronically monitored mechanical pipette with a detachable barrel assembly made in accordance with the principals of the present invention, referred to generally by the reference numeral 10, is provided for cleaning of the detachable barrel assembly without the necessity of subjecting the electrical components of the pipette to the cleaning process.

Figure 2:
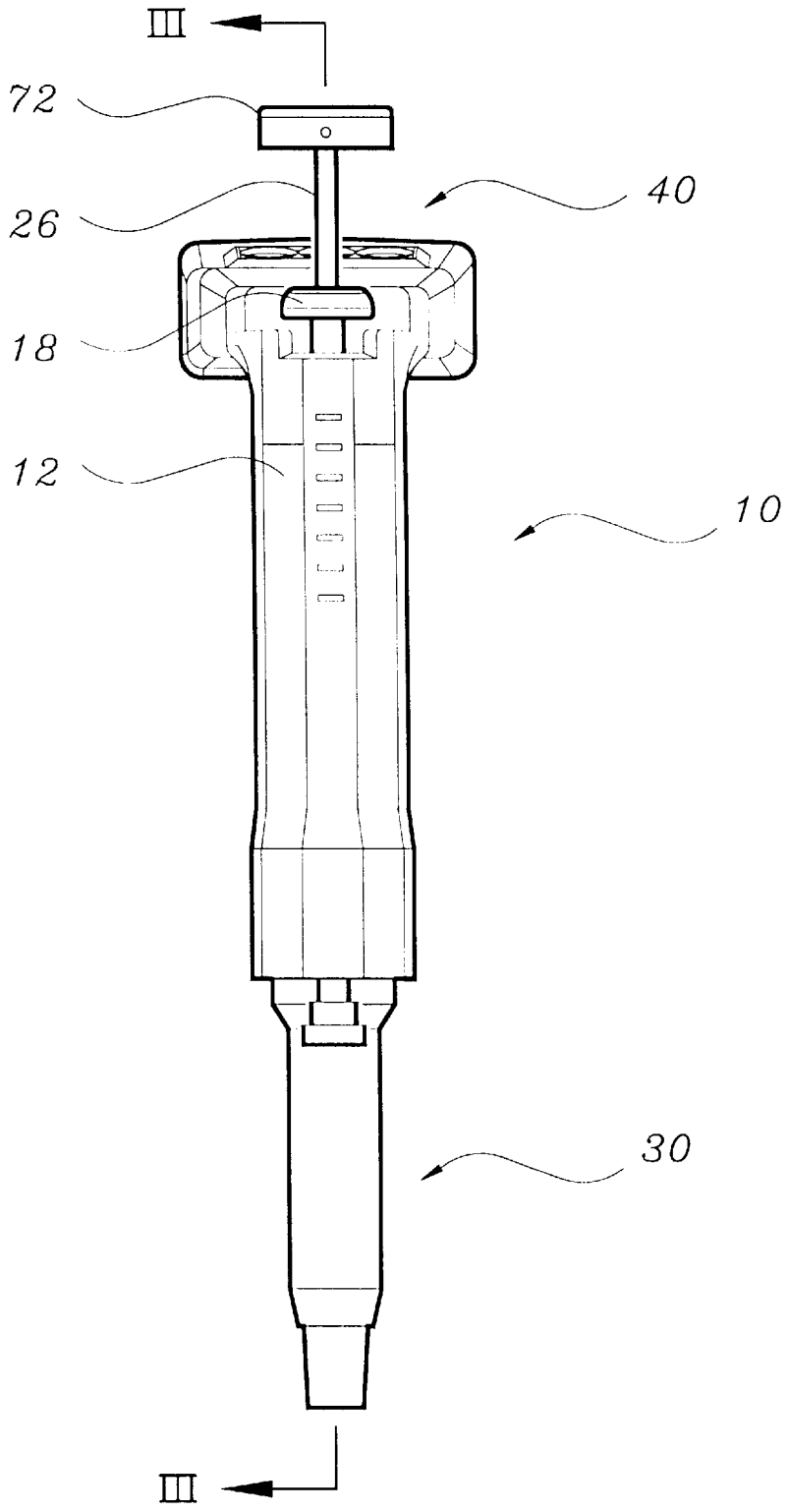
FIG. 2 is a front view of the pipette of FIG. 1.
Figure 3:
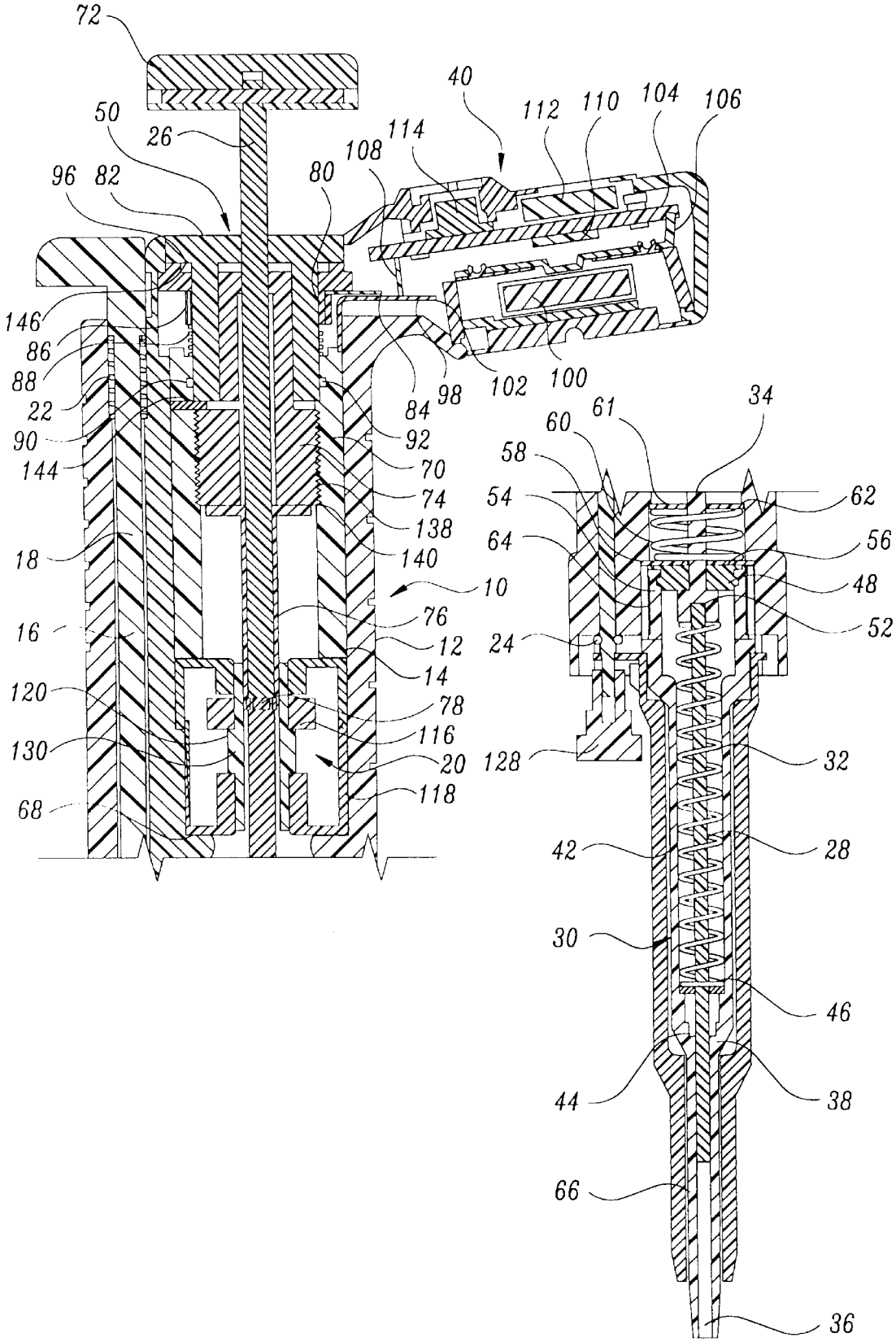
FIG. 3 is a cross-sectional view taken along line III—III of FIG. 2.

More specifically, as shown in FIGS. 1–3, the pipette 10 of the present invention includes a housing 12 having a first generally cylindrical bore 14 passing longitudinally therethrough which contains a transducer assembly 20 centrally located therein, a microswitch assembly 50 positioned at the proximal end thereof and a detachable barrel assembly 30 attached to the distal end thereof to extend outwardly in the distal longitudinal direction. The housing 12 also includes a smaller longitudinal bore 16 containing an ejector rod 18, held in its proximal most position by ejector spring 22 and prevented from escaping the smaller bore 16 by O-ring 24. An electronic assembly 40 is attached to the proximal end of the housing 12 and extends away from the housing 12 in a generally perpendicular direction. The housing 12 is designed to be easily gripped in a single hand of an operator such that the electronic assembly 40 remains above the operator's hand for easy viewing by the operator, and the detachable barrel assembly 30 extends below the operator's hand for easy positioning thereof. The pipettor 10 can be operated by manipulation of the ejector rod 18 and the square plunger 26 by the user's thumb as will be explained in more detail below. The barrel assembly 30 can be detached from the remainder of the pipette by unthreading the barrel housing 42 from the bushing barrel 64 as will be explained in more detail below.

ASSEMBLY

Referring again to FIGS. 1–3, assembly of the pipettor 10 of the present invention is preferably initiated with the barrel assembly 30. First, the piston 28 is inserted into the primary spring 32. The proximal end of the piston 28 is then affixed to the piston adaptor 34 and the distal end of piston 28 is inserted into the channel 36 of the barrel housing 42. The channel 36 is sealed against leakage therepast by means of a plug 38, preferably made of Teflon, through which the piston 28 passes and which seats itself in the distal portion of the barrel housing 42 just above the channel 36. The plug 38 is secured for a fluid tight fit against the piston 28 by the seal 44. The seal 44 and plug 38 are held in the distal portion of the barrel housing 42 by washer 46 which is biased downward by the primary spring 32. The force of the washer 46 against the seal 44 assists the seal 44 in squeezing the plug 38 against the piston 28 and also assists in forcing the plug 38 downward against the proximal end of the channel 36. This assists in preventing fluid leakage out of the channel 36. Finally the annular disk 48 is inserted over the piston adaptor 34 and snap-fit into the distal opening of the barrel housing 42. The enlarged end 52 of the piston adaptor 34 is larger in diameter than the annular disk opening 54 and allows the piston adaptor 34 to move longitudinally relative to the barrel housing 42 yet does not allow it to be completely removed therefrom. This completes barrel assembly 30.

Turning now to the housing 12, the primary washer 56 is inserted into the distal end of the housing 12 until it abuts with the shoulder 62 thereof. The secondary spring 60 is then inserted into the distal end of the housing 12 until it abuts primary washer 56. The secondary washer 61 is then placed against the secondary spring 60 to abut with shoulder 58 of the housing 12. The primary washer 56, secondary spring 60 and secondary washer 61 are then permanently held in place within the housing 12 by press fitting the bushing barrel 64 into the distal end of the housing 12. The bushing barrel 64 is threaded on its interior surface and the proximal end of the barrel housing 42 of the detachable barrel assembly 30 is threaded on its exterior surface. In this manner, the entire barrel assembly 30 can be removably attached to the housing 12 by threading the barrel housing 42 into the bushing barrel 64.

Figure 10:
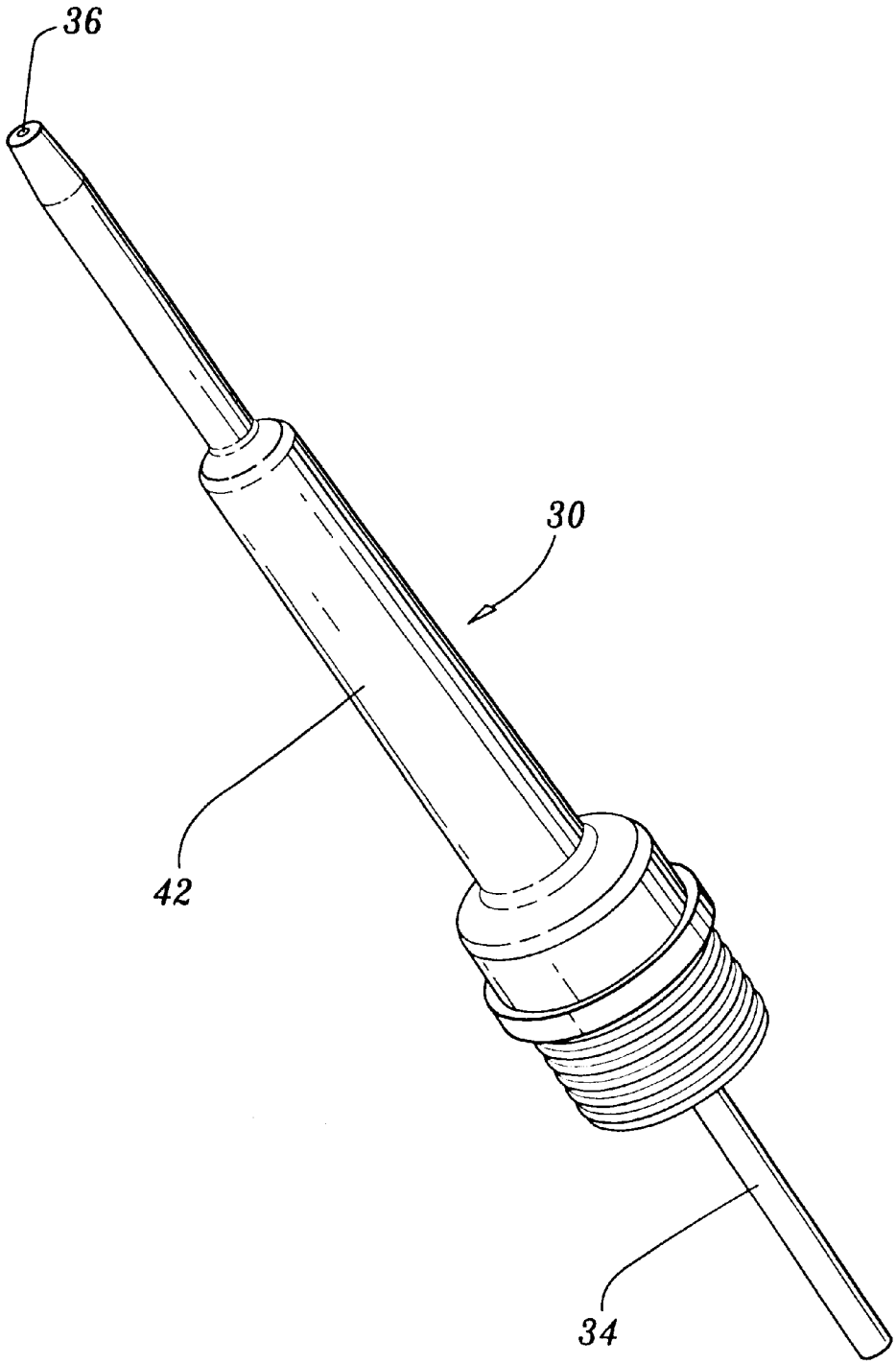
FIG. 10 is a perspective view of a detachable barrel assembly made in accordance with the principals of the present invention.
Figure 12:
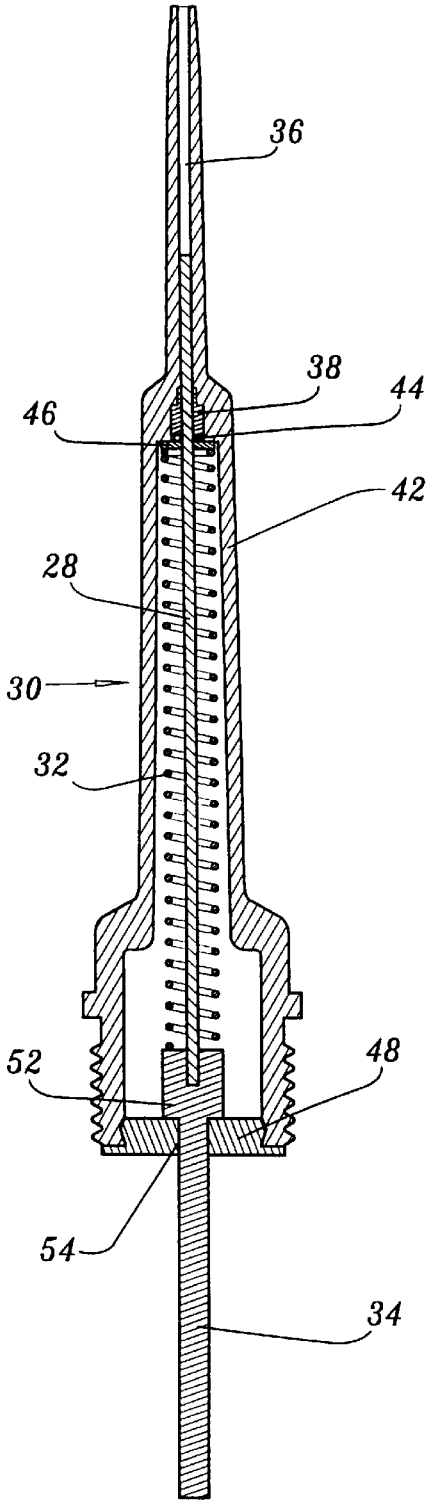
FIG. 12 is a cross-sectional view taken along line XII—XII of FIG. 11.
Figure 11:
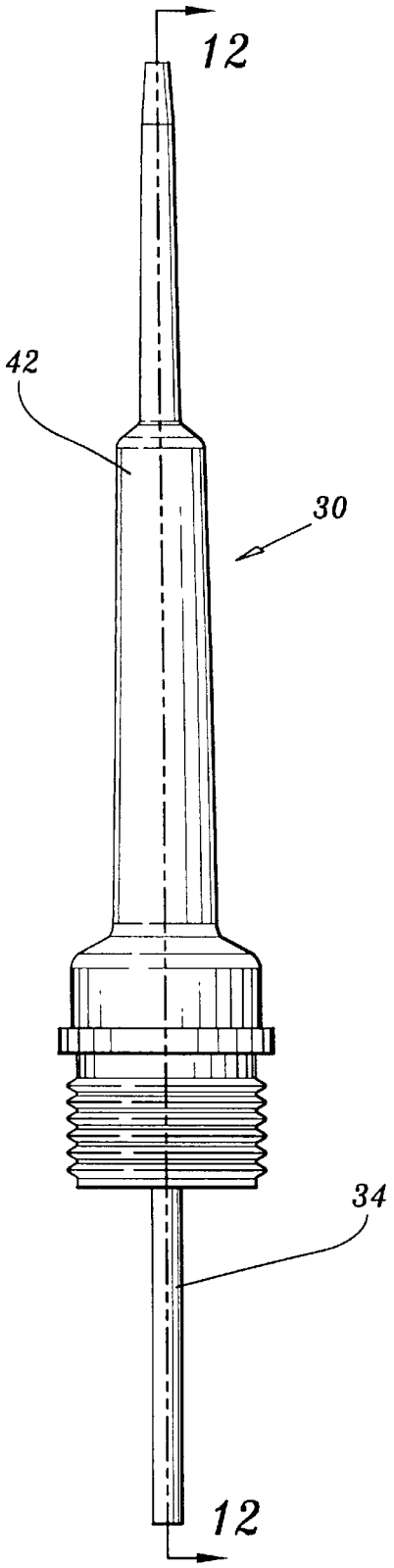
FIG. 11 is a front view of the detachable barrel assembly of FIG. 10.

FIGS. 10–12 show the entire barrel assembly 30 when removed from the remainder of the pipette 10. As can be seen the piston adaptor 34 is held within the barrel assembly 30 by its enlarged end 52 being trapped in the annular disk opening 54. The primary spring 32 holds the piston adaptor 34 in its fully extended position. While detached from the pipette 10, the barrel assembly 30 can be cleaned such as by autoclaving without causing any damage to any elements thereof. When it is desired to reattach barrel assembly 30 to the pipette 10, the piston adaptor 34 is passed into the housing 12 and through the primary washer 56 and secondary washer 61, and the barrel housing 42 is rotated to engage the threads of the bushing barrel 64. The barrel housing 42 is rotated until the threads are completely threaded, and the end of the piston adaptor 34 abuts the small bushing 78. The ejector barrel 66 is then slid over the barrel housing 42 and nut 128 is screwed on to the bottom end of ejector rod 18. Thereafter, the pipette 10 is again ready to receive a disposable tip (not shown) for use.

Figure 13:
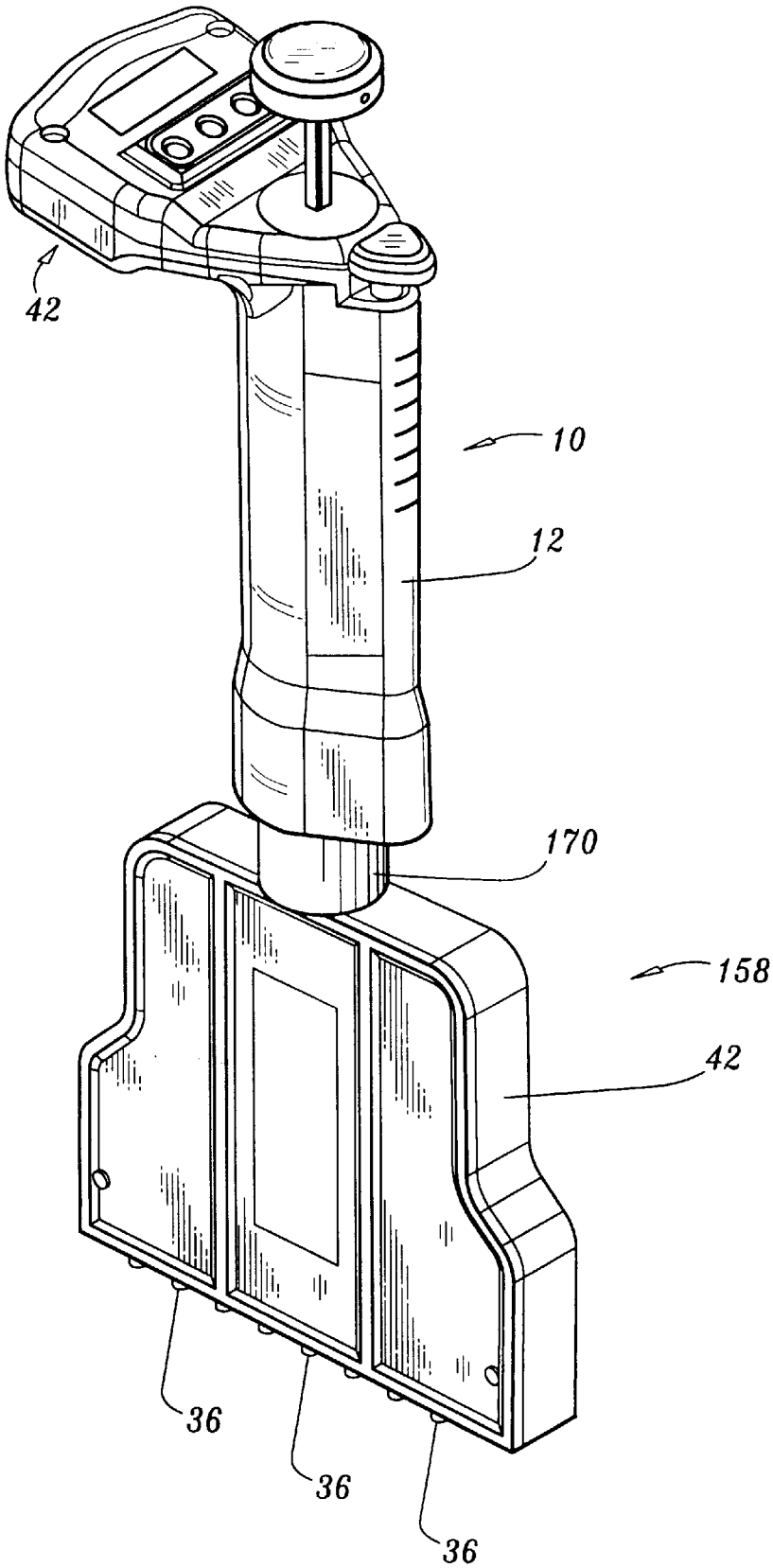
FIG. 13 is a perspective view of a second preferred embodiment of a pipette made in accordance with the principals of the present invention which includes a second preferred embodiment of a detachable barrel assembly.
Figure 14:
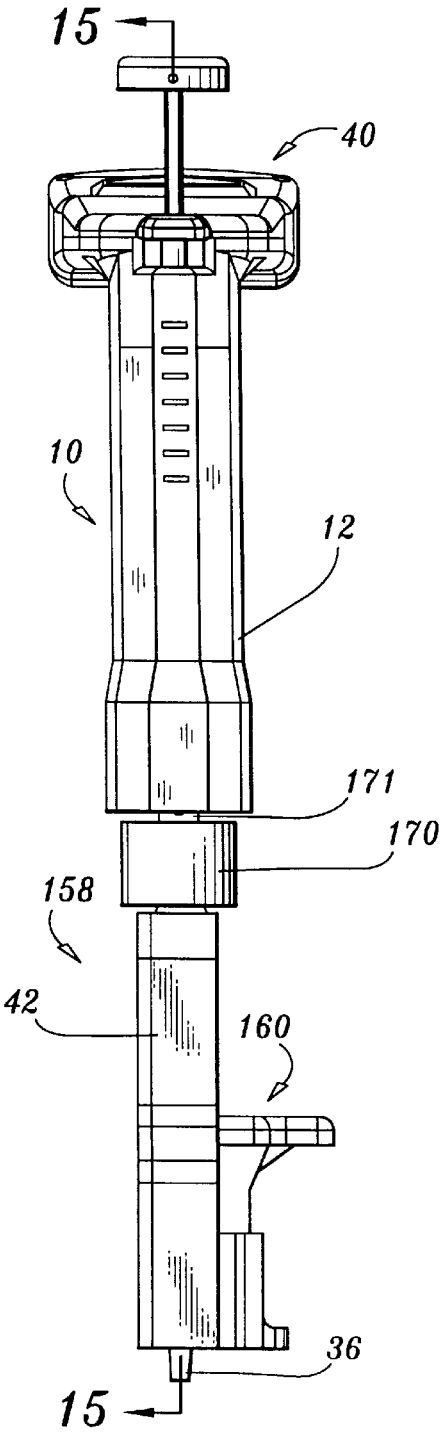
FIG. 14 is a front view of the second embodiment of a pipette of FIG. 13.
Figure 15:
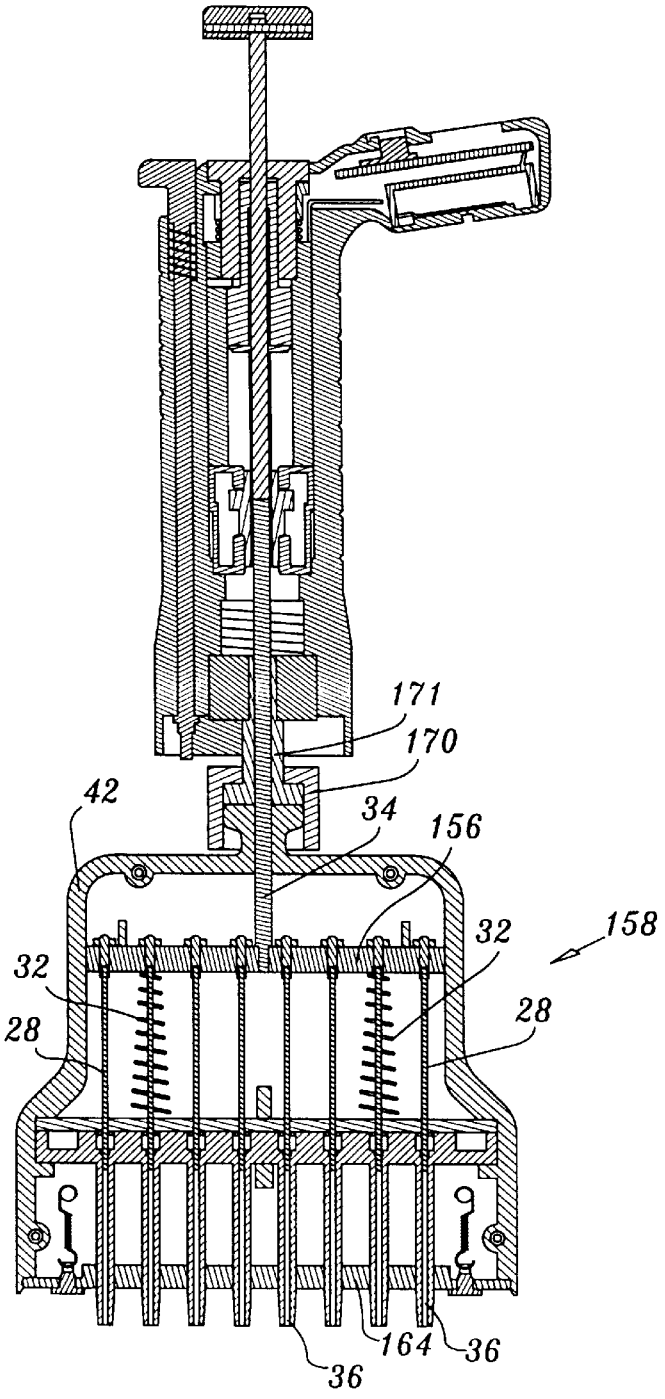
FIG. 15 is a cross-sectional view of the second embodiment of a pipette taken along line XV—XV of FIG. 14.

FIGS. 13–15 show a second preferred embodiment of the barrel assembly of the present invention attached to the pipette 10 for use. The second embodiment of the detachable barrel assembly is referred to generally by the numeral 158. The multi channel barrel assembly 158 operates in a nearly identical manner as the single channel barrel assembly 30 described above, except in that a plurality of doses are delivered.

Figure 16:
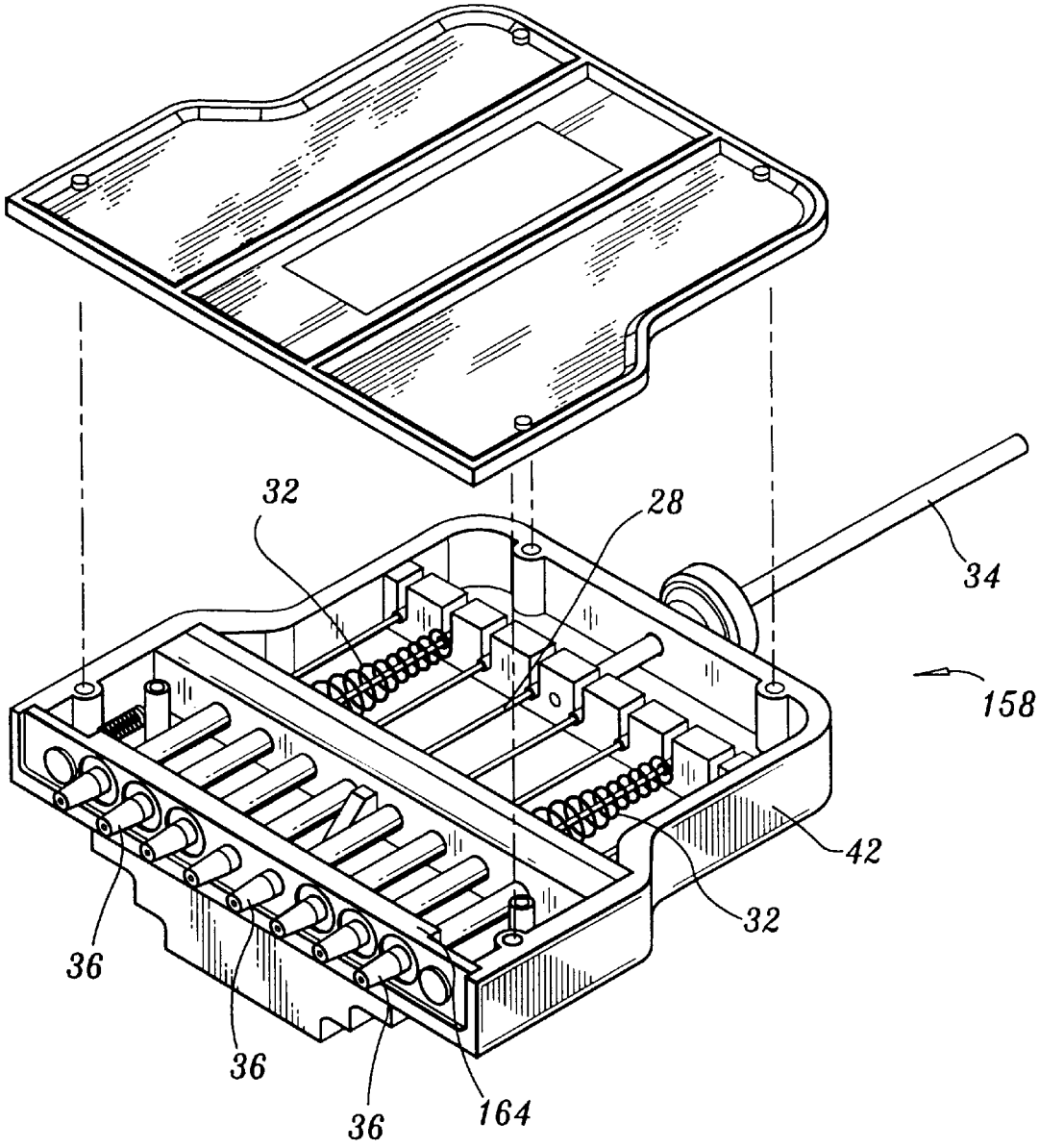
FIG. 16 is an expanded view of the multi channel detachable barrel assembly made in accordance with the principals of the present invention.
Figure 18:
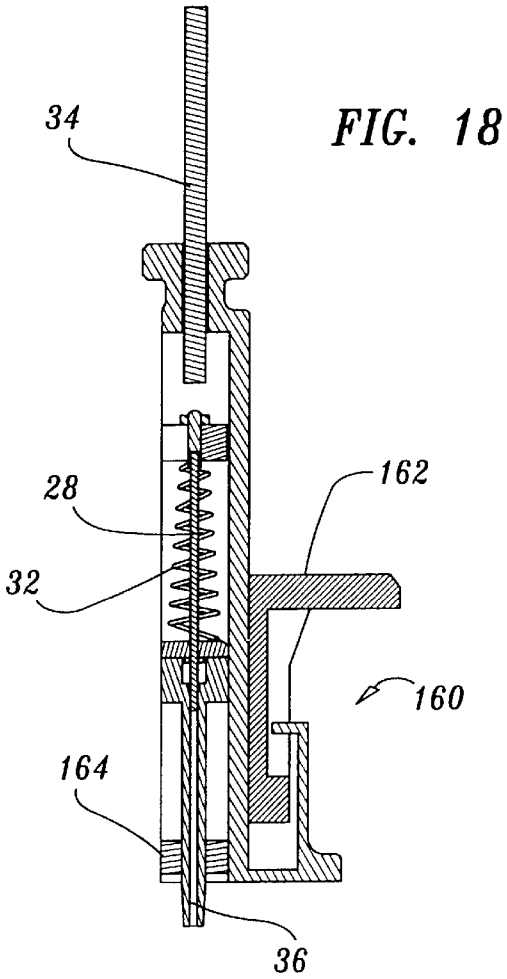
FIG. 18 is a cross-sectional view taken along line XVIII—XVIII of FIG. 17.
Figure 17:
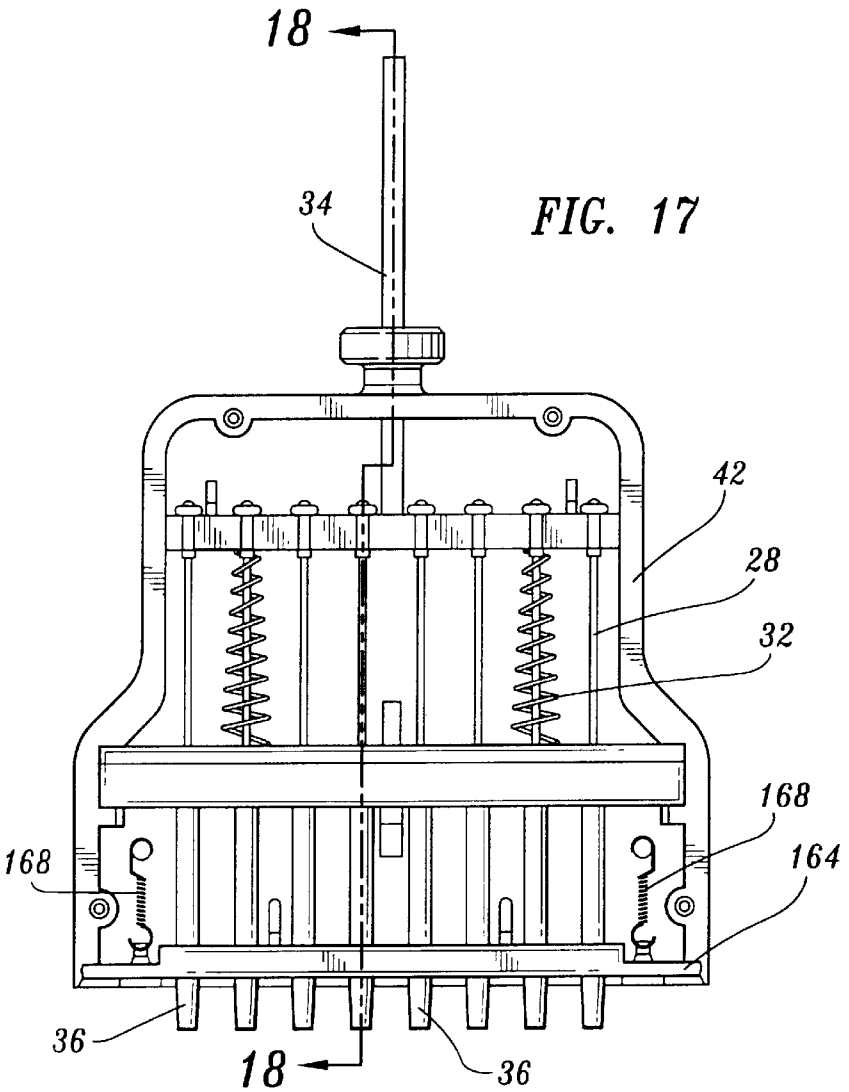
FIG. 17 is a front view of the preferred embodiment of the multi channel barrel assembly with the front cover thereof removed.

Specifically, as can best be seen in FIGS. 16–18, the multi channel barrel assembly 158 is removable from the remainder of the pipette 10 by unscrewing it from the pipettor housing 12. When detached, multi channel barrel assembly 158 remains in tact without any elements therein becoming separated or misplaced. The piston adaptor 34 is held in its fully extended position by one or more primary springs 32, and a plurality of pistons 28 are positioned in a plurality of channels 36. The only substantial operational difference between the multi channel barrel assembly 158 and the single channel barrel assembly 130 of the present invention is the inclusion in multi channel barrel assembly 158 of a piston bar 156 which is attached directly to the piston adaptor 34 and which in turn has the pistons 28 attached directly thereto. In this manner, movement of the single piston adaptor 34 simultaneously operates all of the pistons 28 for simultaneously drying and dispensing fluid from the plurality of channels 36.

The multi channel barrel assembly 158 does not employ the ejector rod 18 for ejecting pipette tips (not shown) from the bottom of the barrel housing 42. Instead, an ejector assembly 160 is activated to remove the pipette tips. The user merely presses downwardly on thumb pad 162 which causes the ejector bar 164 to move downwardly against the springs 168 and thus push the pipette tip from the end of the fluid channels 36. When the thumb pad 162 is released, the springs 168 return the ejector bar 164 to its original position, and the barrel assembly 158 is ready to receive a new set of pipette tips.

Figure 4:
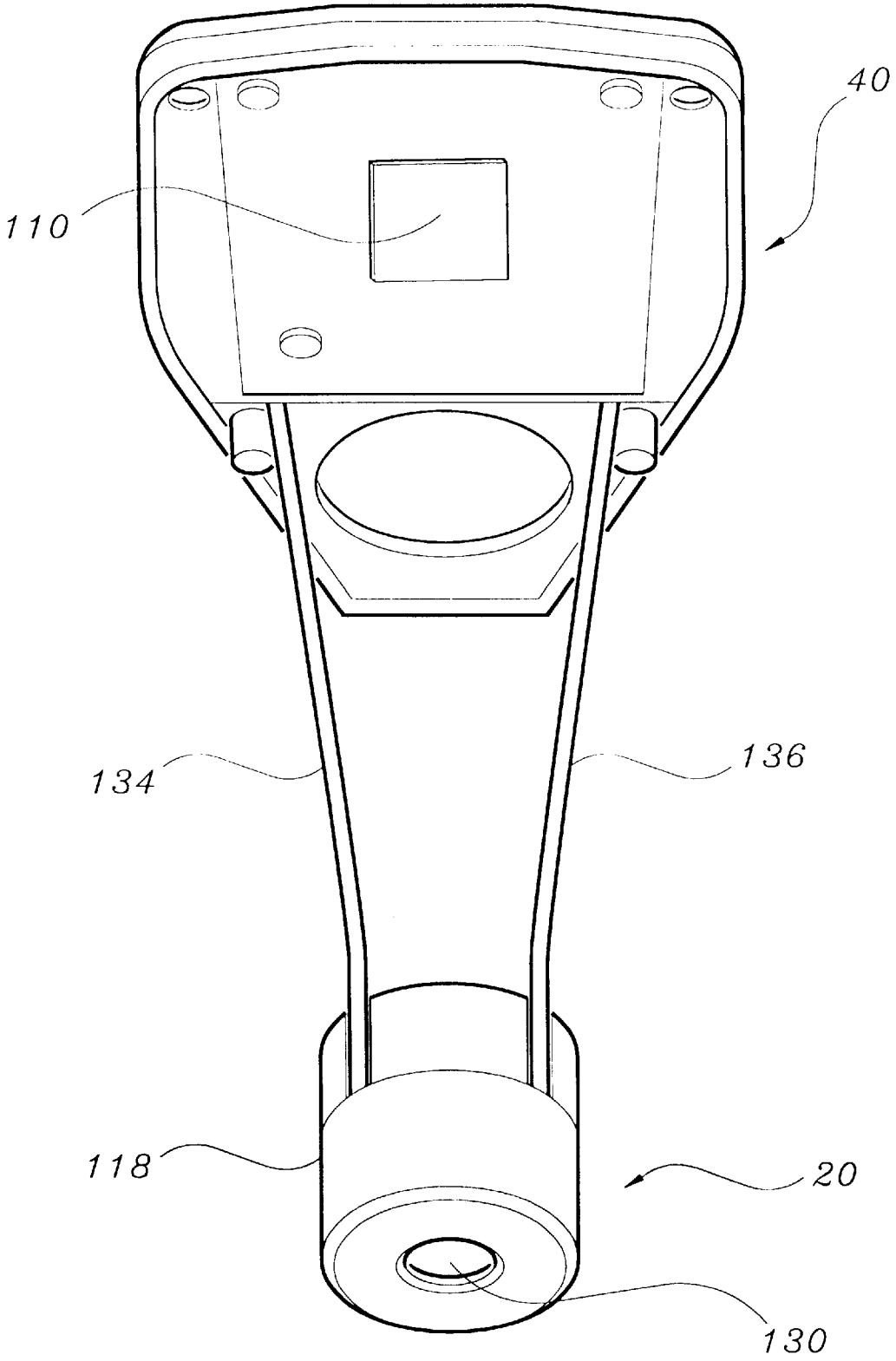
FIG. 4 is a perspective view of a preferred embodiment of an electronics assembly and a transducer assembly made in accordance with the principals of the present invention.
Figure 6:
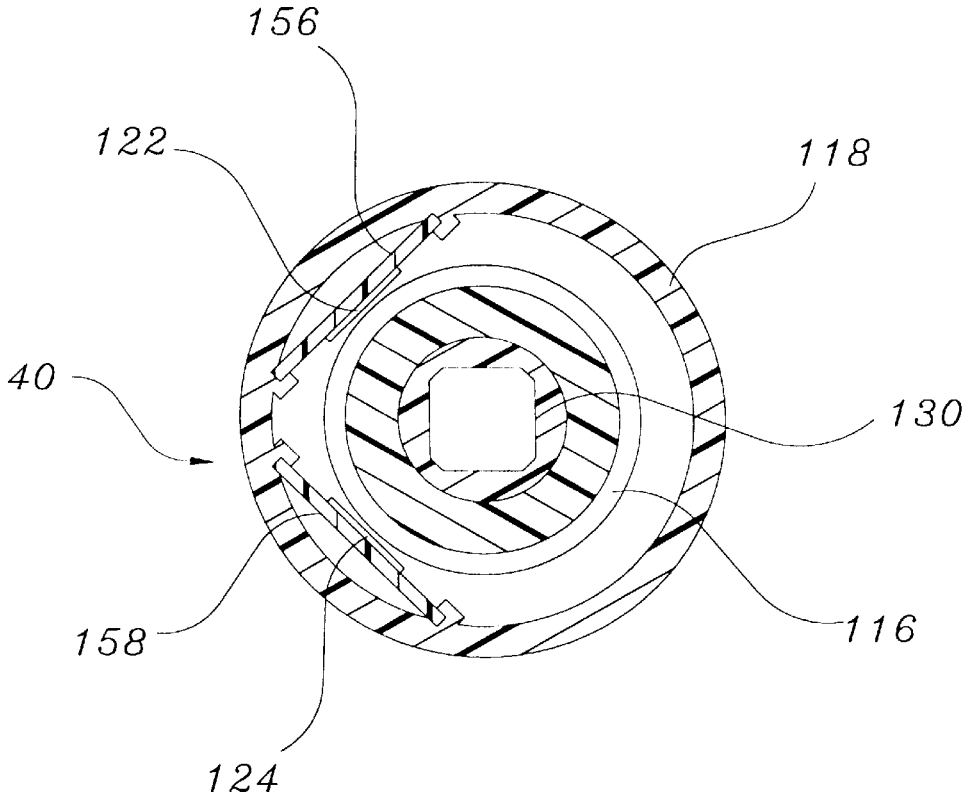
FIG. 6 is a cross-sectional view taken along line VI—VI of FIG. 5.
Figure 5:
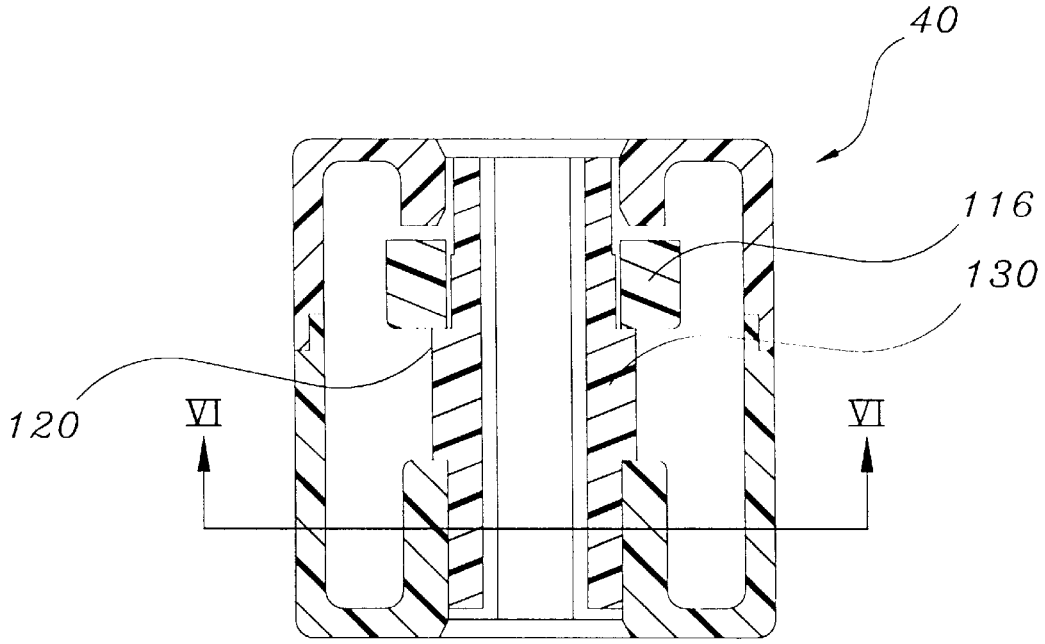
FIG. 5 is a cross-sectional view of a transducer assembly made in accordance with the principals of the present invention.

Referring now to FIGS. 3–5, the transducer assembly 20 includes an annular magnet 116 encased in the transducer housing 118 and held in position on the transducer bearing 130 by abutment against shoulder 120. Sensors 122 and 124 are positioned within the transducer housing 118 at positions 90° apart from each other. The sensors 122 and 124 operate to track the rotation of the annular magnet 116. Leads 134 and 136 extend from the sensors 122 and 124 up to the electronics assembly 40 to allow the sensor signals to pass tot he electronics assembly 40. A more detailed description of the transducer assembly 20 is located in applicant's U.S. application Ser. No. 08/925,980 entitled "Transducer Assembly for an Electronically Monitored Mechanical Pipette" filed Sep. 9, 1997 and now U.S. Pat. No. 5,892,161 which is incorporated herein by reference in its entirety.

As best seen in FIG. 3, the square plunger 26 is next inserted through the advancer 74. The transducer driver 76 is then inserted over the distal end of the plunger 26 and attached to the distal end of the advancer 74 by means of screws or the like. The distal end of the transducer driver 76 forms a reduced diameter threaded extension to which a small bushing 78 is threadedly attached. The small bushing 78 is of a larger diameter than the plunger 26 and thus interferes with the distal end of the transducer driver 76 to preventing the plunger 26 from being withdrawn therefrom.

Figure 7:
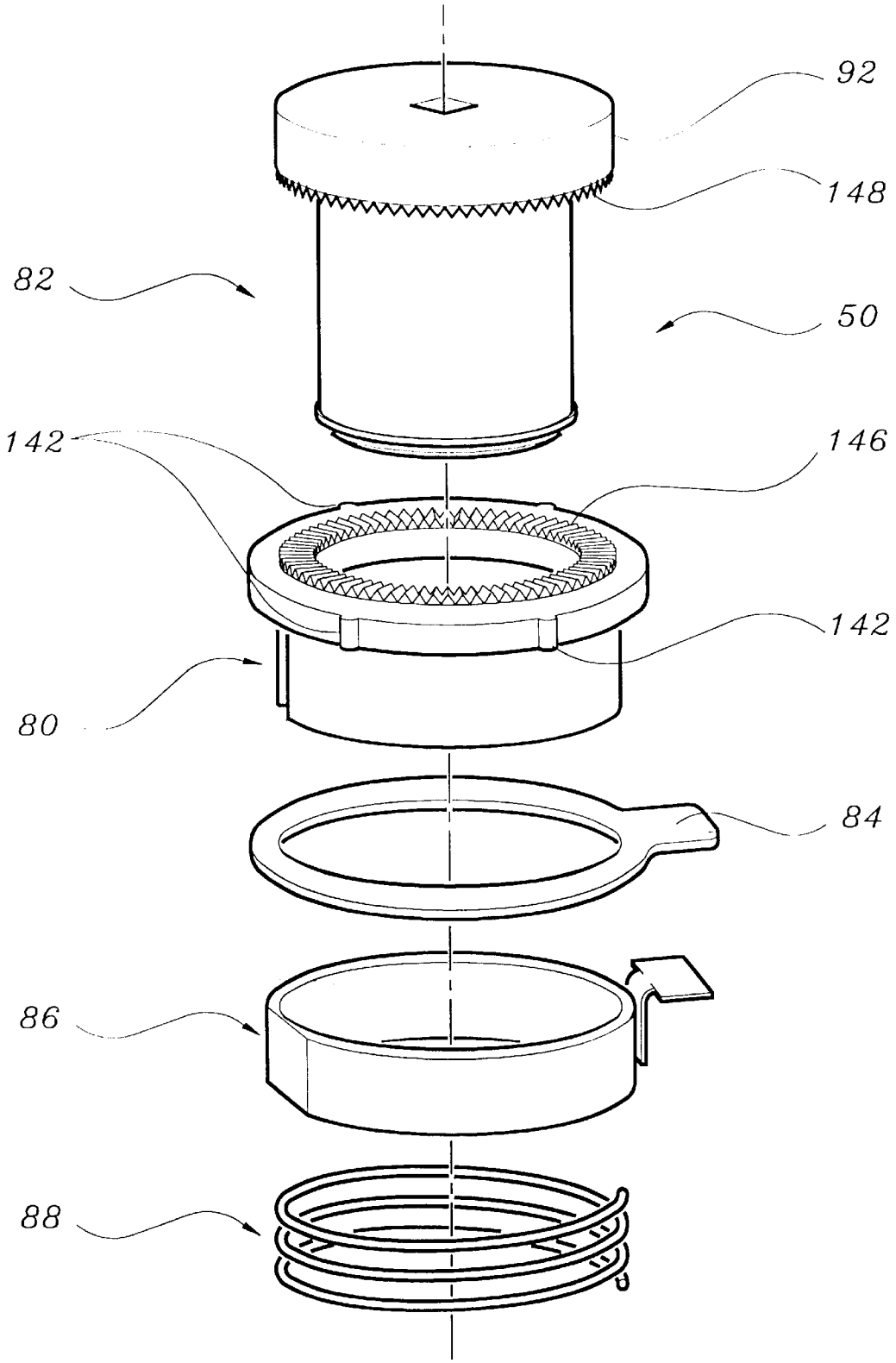
FIG. 7 is an exploded view of a preferred embodiment of a microswitch assembly made in accordance with the principals of the present invention.

Referring now to FIGS. 3 and 7, the microswitch assembly 50 is assembled by first sliding the square opening of the bobber guide 82 over the proximal end of the square plunger 26, and attaching the button 72 to the proximal end of the plunger 26. Next, the bobber 80 is inserted over the bobber guide 82 and the bobber switch 84 is inserted over the bobber 80 and held in place by the retaining ring 86. The bobber spring 88 is then inserted over the bobber guide 82 until it abuts against the retaining ring 86 and the retainer 90 is attached to the distal end of the bobber guide 82. Threads 138 of the advancer 74 are then advanced into the threads 140 of bushing 70. The bobber guide 82 is then inserted into the bushing 70 until the retainer 90 snap fits into a retainer slot 92 in the interior annular surface of the bushing 70 just above threads 140. This action causes the bobber spring 88 to be biased between the retaining ring 86 and shoulder 94 in the proximal end of the bushing 70. In this manner, the bobber 80 is always biased upward against the enlarged flange portion 96 of the bobber guide 82. When completely assembled, the bobber 80 is prevented from rotating by the keys 142 thereon which match keyways (not shown) in bore 16. Similarly, pin 144 prevents the advancer 74 from rotating above the threaded portion of the bushing 70, and a key and keyway (not shown) are used to prevent rotation of the transducer housing 118. Thus, rotation of button 72 by the operator causes the plunger 26, advancer 74 and transducer driver 76 to rotate and translate in the upward or downward direction. Translational (longitudinal) distance is controlled by the pitch of threads 138 and 140, and the number of rotations of the button 72.

Likewise, rotation of button 72 causes rotation (but not translation) of bobber guide 82, transducer bearing 130 and annular magnet 116.

The rotational motion of the bobber guide 82 causes the bobber 80 to move downwardly. Since the bobber 80 is held against rotation by the keys 142 positioned in keyways (not shown) in the bore 16, the bobber 80 must move downwardly to unmesh bobber teeth 146 from bobber guide teeth 148. This downward motion causes the bobber switch 84 to contact the stationary switch pad 98, and continues until the bobber teeth 146 slip past the bobber guide teeth 148. This downward movement distance in the preferred embodiment is approximately 0.030 inches. The bobber 80 is then biased upwardly again by bobber spring 88. This continues as further rotation occurs, and results in a "bobbing" motion of bobber 80 until rotation of the button 72 is stopped.

Once the transducer assembly 20 and microswitch assembly 50 are completed, the transducer assembly 20 is inserted into the housing 12 through the proximal opening of bore 14 and held in position against shoulder 68 by bushing 70. The bushing 70 includes flattened surfaces (not shown) which form small longitudinal channels (not shown) in conjunction with the bore 14, through which the leads 134 and 136 pass from the transducer assembly 20 to the electronics assembly 40.

The stationary switch pad 98 is held in position at the top of the housing 12 by screws or the like, and a portion thereof extends into the bore 14 to contact and assist in retaining the bushing 70 in its proper position within the bore 14. The bobber switch 84 extends over and above the stationary switch pad 98 and is held in a spaced apart position therefrom by the bobber spring 88.

Figure 8:
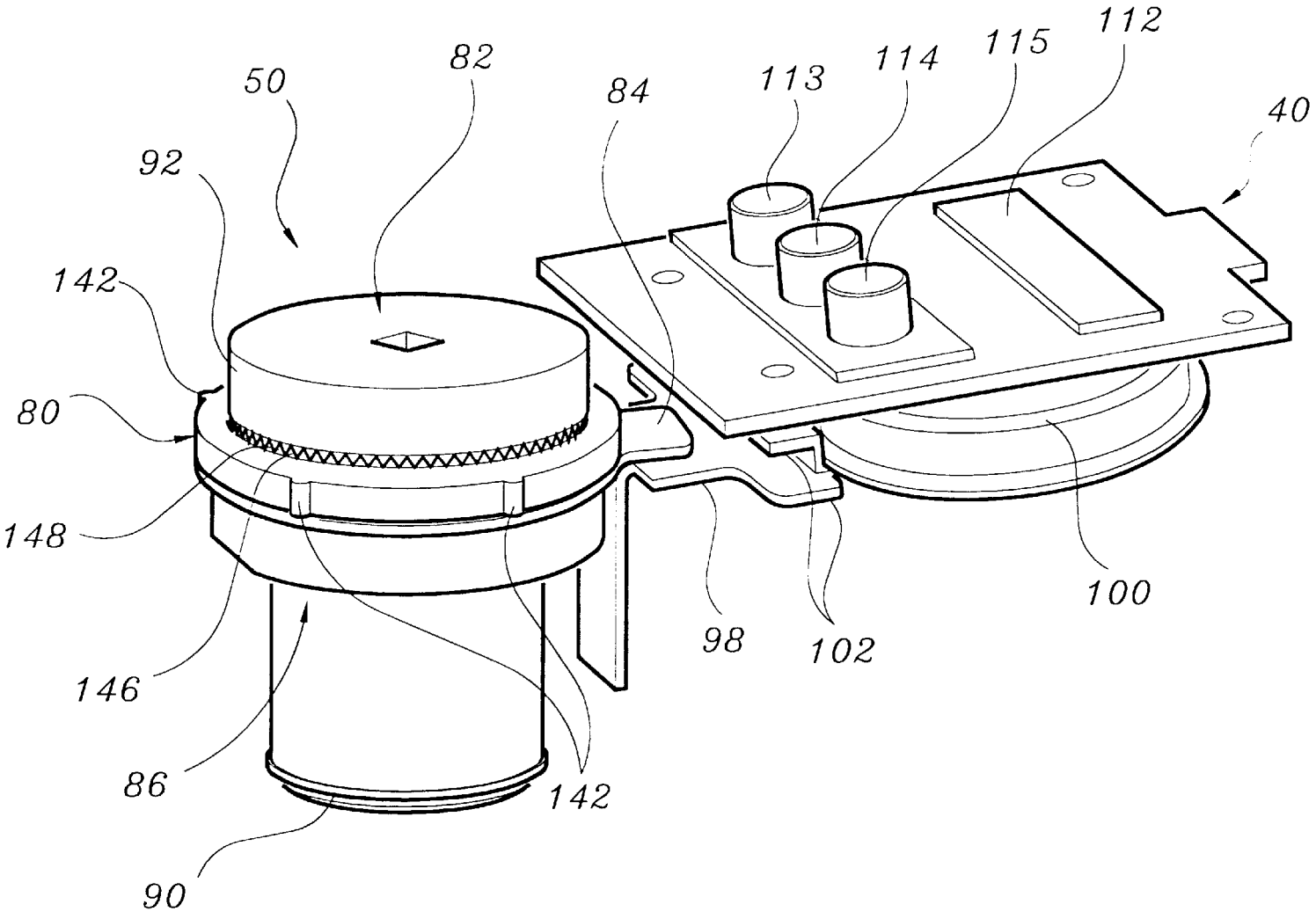
FIG. 8 is a perspective view of a preferred embodiment of a microswitch assembly and an electronics assembly made in accordance with the principals of the present invention with the housing of the electronics assembly removed.
Figure 9:
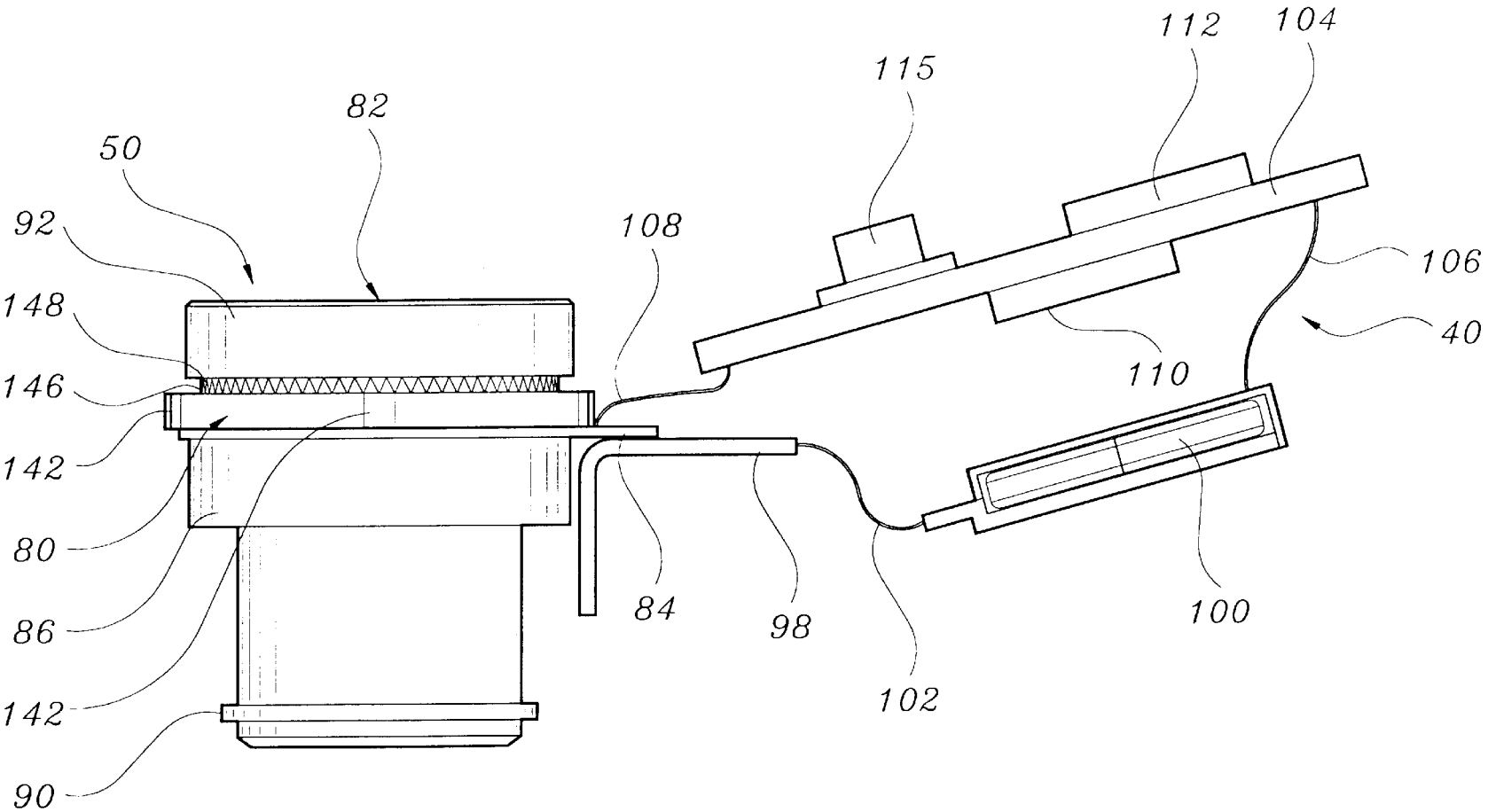
FIG. 9 is a side view of the microswitch assembly and electronics assembly of FIG. 8.

As shown in FIGS. 8 and 9, the stationary switch pad 98 is in electrical contact with the electronic assembly 40 and likewise forms part of the electrical volume monitoring system by being attached to the negative side of the batteries 100 through lead 102 and to the positive side of the circuit board 104 by lead 106. The circuit board itself is connected to the positive side of the batteries 100 by lead 108. The circuit board 104 has attached thereto the microprocessor 110, the LCD display 112, the calibration buttons 113, 114, 115 and the leads 134 and 136 from the transducer assembly 20.

Finally, referring now to FIG. 3, the ejector spring 22 is inserted over the ejector rod 18 and the ejector rod 18 is subsequently inserted through the small bore 16 of the housing 12. The O-ring 24 is attached to a distal portion of the rod 18 to retain it within the small bore 16. The distal end of ejector rod 18 is threaded and sized to receive the ejector barrel 66 which is held in place by nut 128.

In use, a disposable pipette tip (not shown) is attached to the distal end of the barrel housing 42 to be in fluid flow communication with the fluid channel 36 and to abut the distal end of the ejector barrel 126. When it is desired to dispose of the pipette tip, the operator presses down on the ejector rod 18 with the thumb of the hand holding the pipette 10. This causes the ejector rod 18 and the ejector barrel 66 to move distally and push the pipette tip off of the distal end of the barrel housing 42.

OPERATION

The pipette 10 of the present invention operates as follows. The operator, using the thumb of the hand holding the pipette 10, presses down on button 72 until the small bushing 78 on the distal end of the plunger 26 touches the primary washer 132. This motion is resisted by the primary spring 32 through the piston adaptor 34. This motion also brings the piston 28 downwardly along the channel 36. The operator then inserts the distal end of the pipette 10 (with a disposable pipette tip mounted thereon) into a fluid to be pipetted. The operator releases the button 72 and the primary spring 32 returns to its fully upwardly extended positions, and draws piston 28 in a proximal direction, causing the pipette tip to be filled with fluid. The operator then inserts the distal end of the pipette 10 into the container to receive the fluid and again forces button 72 downwardly with the thumb until the small bushing 78 touches the primary washer 56. The user continues downward force on the button 72 to cause the primary washer 132 to also move downwardly against the force of the secondary spring 60 until it is completely compressed. At this point, the preset volume of fluid has been delivered from the pipette tip.

If the operator desires to change the fluid volume delivery setting, the operator rotates button 72 either clockwise to reduce the volume delivery setting, or counterclockwise to increase the volume delivery setting. Rotation of button 72 causes rotation of bobber guide 82, threaded advancer 74, transducer drive 76, transducer bearing 130, and the annular magnet 116. Rotation of the thread advancer 74 (by rotation of button 72) causes the threaded advancer 74 to rotate through the threads 140 on the inside of the bushing 70 and thereby move in a longitudinal direction. This longitudinal movement also forces longitudinal movement of the plunger 26 and the transducer driver 76.

Rotational motion of the bobber guide 82, causes the bobber 80 to be forced downwardly in the distal direction against the bobber spring 88 until the bobber switch 84 contacts the stationary switch pad 98. In the preferred embodiment, the gap between the bobber switch 84 and the stationary switch pad 98 is approximately 0.010 to 0.0.15 inches. Since the bobber 80 is keyed to the housing 12, and therefore cannot rotate, it moves downward to allow the meshing teeth 148 of the bobber guide 82 to pass over the meshing teeth 146 of the bobber 80 (approximately 0.030 inches). The individual teeth of the meshing teeth 146 and 148 are preferably sized to cause the bobber 80 to "bob" approximately every 6° of rotation. Each time the bobber is forced downwardly due to rotation of the bobber guide 82, the bobber switch 84 is forced into contact with the stationary switch pad 98 (since the gap between them is only approximately 0.010 to 0.015 inches, and the downward movement of the bobber switch is approximately 0.030 inches which exceeds the gap). The bobber spring 88 then forces the bobber 80 upwardly again against the bobber guide 82. When the bobber 80 is again in its upwardmost position, the bobber switch 84 is again spaced away from the stationary switch pad 98. The contact of bobber switch 84 with the stationary switch pad 98 sends an interrupt signal to the microprocessor 110 which it recognizes as a signal to power up the sensors 122 and 124 in the transducer assembly 20.

As the annular magnet 116 rotates, the magnetic field thereof passes through the sensors 122 and 124. The sensors 122 and 124 produce a current output based on the changing magnetic field passing therethrough which is sent to the microprocessor 110 through leads 134 and 136. The microprocessor computes a new volume delivery setting based on the signals it receives from the sensors 122 and 124 and displays the new volume setting in display 112. The operational features of the transducer assembly 20 and electronics assembly 40 are more completely described in applicant's co-pending U.S. application Ser. No. 08/925,980 identified above. Also, a more detailed discussion of the electronic volume monitoring system, including calibration thereof, is included in applicant's co-pending U.S. patent application Ser. No. 08/926,371 entitled "Calibration System for an Electronically Monitored Mechanical Pipette" filed Sep. 9, 1997 which is incorporated herein by reference in its entirety.

When the operator stops turning the knob 72, the bobber 80 is again biased to its upward proximal position by the bobber spring 88, and the bobber switch 84 is separated from the stationary switch pad 98. After a short period of time, preferably approximately 100 milliseconds after receiving its last interrupt signal, the microprocessor 110 turns off the power to the transducer assembly 20. The display 112 however remains powered, and continuously displays the current fluid delivery setting. In this manner, when the pipette 10 is not activated to change a fluid delivery setting, the power consumption thereof is limited to the power required to maintain the current fluid delivery setting displayed on the display 112 (approximately 10 microamps). The high power requirements of the transducer assembly 20. (approximately 170 milliamps) are only being consumed therefor when the pipette 10 is actually being operated to change its fluid volume delivery setting.

Operation of the pipette 10 of the present invention when used with the multi channel barrel assembly 158 is identical to that described above with respect to the single channel barrel assembly 30.

When it is desired to clean the pipette 10, the user merely removes the nut 128 from the ejector rod 18 and slides the ejector barrel 66 off of the barrel assembly 30. The barrel assembly 30 is then removed by rotating the barrel housing 42 thereof, with respect to the pipette housing 12 until it is disengaged from the threads of the bushing barrel 64.

The multi channel barrel assembly 158 is removed from the remainder of the pipette 10 by merely rotating the lock nut 170 with respect to the adaptor 171. There is however, no need to disengage the ejector assembly 160 therefrom, since it is not itself attached directly to the remainder of the pipette 10, or the ejector rod 18.

It will be apparent from the foregoing that, while particular embodiments of the invention have been illustrated and described, various modifications can be made thereto without departing from the spirit and scope of the invention. Accordingly, it is not intended that the invention be limited, except as by the appended claims.

We claim:

1. A detachable barrel assembly for an electrically monitored mechanical pipette, said detachable barrel assembly comprising:

a barrel housing, said housing including means for removable attachment thereof to an electrically monitored mechanical pipette, said barrel housing further including at least one channel extending therefrom and at least one piston positioned at least partially within said housing and within said at least one channel for linear movement therein; and said detachable barrel assembly further including means for holding said piston and said channel in predetermined relative positions with respect to said housing when said detachable barrel assembly is detached from the pipette.

2. A detachable barrel assembly according to claim 1 wherein said barrel housing further includes at least one spring therein for biasing said at least one piston relative to said at least one channel.

3. A detachable barrel assembly according to claim 1 wherein said barrel housing includes a plurality of pistons and channels.

4. A detachable barrel assembly according to claim 1 wherein said piston and said channel are positioned relative to one another by a biasing force acting on said piston.

5. A detachable barrel assembly according to claim 1 wherein said piston is biased against at least a portion of said barrel housing when said detachable barrel assembly is detached from the pipette.

6. An electrically monitored mechanical pipette for delivering a predetermined volume of fluid therefrom, said pipette comprising:

a volume delivery adjustment mechanism, a monitoring assembly for producing at least one signal related to movement of said volume delivery adjustment mechanism, an electronics assembly for computing and displaying a fluid volume delivery setting based on said at least one signal, and a detachable barrel assembly comprising a barrel housing, said housing including means for removable attachment thereof to an electrically monitored mechanical pipette, said barrel housing further including at least one channel extending therefrom and at least one piston positioned at least partially within said housing and said at least one channel for linear movement therein; and said detachable barrel assembly further including means for holding said piston and said channel in predetermined relative positions with respect to said housing when said detachable barrel assembly is detached from said pipette.

7. An electronically monitored mechanical pipette according to claim 6 wherein said piston and said channel are positioned relative to one another by a biasing force acting on said piston.

8. An electronically monitored mechanical pipette according to claim 6 wherein said piston is biased against at least a portion of said barrel housing when said detachable barrel assembly is detached from the pipette.

9. An electronically monitored mechanical pipette according to claim 6 wherein said barrel housing further includes at least one spring member therein for biasing said at least one piston relative to said at least one channel.

* * * * *

UNITED STATES PATENT AND TRADEMARK OFFICE

CERTIFICATE OF CORRECTION

PATENT NO. : 6, 019, 004

DATED : February 1, 2000

INVENTOR(S) : Conley et. al.

It is certified that error appears in the above-identified patent and that said Letters Patent are hereby corrected as shown below:

Column 6, Line 8. The words "tot he" are misspelled. Please change "tot he" to --to the--.
Column 6, Line 23. Please change the word "preventing" to --prevent--.
Column 8, Line 20. Please change "0.0.15" to --0.015--.

Signed and Sealed this

Third Day of April, 2001

*Attest:*

Nicholas P. Godici

NICHOLAS P. GODICI

*Attesting Officer*

*Acting Director of the United States Patent and Trademark Office*